US009534495B2

(12) United States Patent
Smit

(10) Patent No.: US 9,534,495 B2
(45) Date of Patent: Jan. 3, 2017

(54) ROCK ANCHORING SYSTEM AND METHOD

(71) Applicant: Jurie Pretorius Smit, Maroelasfontein (ZA)

(72) Inventor: Jurie Pretorius Smit, Maroelasfontein (ZA)

( * ) Notice: Subject to any disclaimer, the term of this patent is extended or adjusted under 35 U.S.C. 154(b) by 0 days.

(21) Appl. No.: 14/437,190

(22) PCT Filed: Oct. 25, 2013

(86) PCT No.: PCT/IB2013/059665
§ 371 (c)(1),
(2) Date: Apr. 20, 2015

(87) PCT Pub. No.: WO2014/064653
PCT Pub. Date: May 1, 2014

(65) Prior Publication Data

US 2015/0267537 A1 Sep. 24, 2015

(30) Foreign Application Priority Data

Oct. 26, 2012 (ZA) ..... 2012/08099

(51) Int. Cl.
*E21D 21/00* (2006.01)
*E21D 21/02* (2006.01)
*E21D 20/02* (2006.01)

(52) U.S. Cl.
CPC ..... *E21D 21/0026* (2013.01); *E21D 20/02* (2013.01); *E21D 20/026* (2013.01); *E21D 21/0046* (2013.01); *E21D 21/02* (2013.01)

(58) Field of Classification Search
CPC ..... E21D 21/02
See application file for complete search history.

(56) References Cited

U.S. PATENT DOCUMENTS 3,940,941 A * 3/1976 Libert ..... F16B 35/04 405/259.6
4,648,753 A * 3/1987 Stephan ..... E21D 21/0033 405/259.5
4,704,053 A 11/1987 Hipkins, Sr. et al.
5,387,060 A * 2/1995 Locotos ..... E21D 21/0026 405/259.3
2008/0219775 A1* 9/2008 Mercier-Langevin E21D 20/026 405/259.6

FOREIGN PATENT DOCUMENTS

DE 3717024 12/1988
WO WO 2007/059580 5/2007

* cited by examiner

*Primary Examiner* — Tara M. Pinnock
(74) *Attorney, Agent, or Firm* — Law Offices of Steven W. Weinrieb

(57) ABSTRACT

This invention discloses an underground rock anchoring system comprising a rock bolt having a bolt shaft operatively locatable in an elongate rectilinear hole drilled into a hanging wall such that an end portion of the bolt shaft protrudes from the hole, the bolt shaft having a side wall defining a hollow internal chamber extending along at least part of the length of the bolt shaft, a bearing plate adapted to be fitted over the protruding end portion of the bolt shaft for bearing against a rock surface of the hanging wall; and fastening means for pulling the bearing plate taut against the rock surface of the hanging wall. The invention also extends to a rock anchoring method in which such system is used.

14 Claims, 5 Drawing Sheets

ROCK ANCHORING SYSTEM AND METHOD

THIS INVENTION relates to rock anchoring methods. More particularly the invention relates to a rock anchoring system for use in an underground environment.

BACKGROUND TO THE INVENTION

An ore body, which is of a payable grade sufficient to support an underground mining operation, can be accessed via shafts or inclines. To further facilitate access to the ore body horizontal excavations called levels are excavated horizontally off the shafts or inclines, whereas stopes are excavated generally perpendicular to the levels.

Mining operational safety requires that when a workman is underground, i.e. standing in the stopes or on various levels with a footwall under his feet and with the hanging wall hanging above him, proper measures need to be in place to maintain the stability of the excavated areas and to prevent ground from collapsing onto the workman. In the past, a variety of methods and devices have been derived in an attempt to address this need, one of which is an anchor bolt or so-called 'rock bolt' forming part of a rock anchoring system. A rock anchoring system transfers load from the unstable exterior of the hanging wall to the confined, and more stable, interior of the rock mass surrounding the hanging wall. Rock bolts are thus not only used extensively for slope or level stabilization, but also provide tie back and tie down positions.

It is known that a rock anchoring system can be secured in the interior of the rock mass with a mechanical means and/or epoxy means of establishing a set. As such, holes are drilled into the hanging wall so as to accommodate bolt shafts of the rock bolts. When an epoxy resin is used, the resin grout develops a bond superior to that developed by, for example, a cement grout. Fast setting of the resin grout is then necessary to allow transfer of load to the rock formation within minutes after installing the bolt shaft into the drilled hole with epoxy resin grout therein.

Ubiquitous rock anchoring systems typically include a rock bolt having a bolt shaft, of which a screw threaded portion projects from a rock surface of the hanging wall when a major portion of the shaft is set within the drilled hole; a bearing plate/washer which is fitted over the bolt shaft; and a nut which is screw threaded onto the screw threaded portion of the bolt/shaft. The nut bears against the bearing plate which, in turn, bears against the rock surface of the hanging wall.

In some instances the holes drilled into the hanging wall are up to three meters long. Accordingly, bolt shafts of three meters and longer are required to fit into, and protrude from, these holes. The bolt shafts are further manufactured from solid metal or metal alloys and, thus, have a considerable weight which hampers the ability of a workman to move or carry the rock bolts around in the levels or stopes.

A further problem with existing rock anchoring systems is that they tend to loosen from their set positions in the hanging wall, especially when rock blasting operations occur nearby.

As such, it would be advantageous to introduce a rock anchoring system having features permitting it to be easily handled by workmen and the like in an underground environment. It would also be advantageous to introduce a rock anchoring system having features which improve the traction of a bolt shaft of such a system in the rock mass surrounding the hanging wall or the traction of the bolt shaft in the epoxy means.

SUMMARY OF THE INVENTION

In accordance with this invention there is provided an underground rock anchoring system comprising a rock bolt having a bolt shaft operatively locatable in an elongate rectilinear hole drilled into a hanging wall such that an end portion of the bolt shaft protrudes from the hole, the bolt shaft having a side wall defining a hollow internal chamber extending along at least part of the length of the bolt shaft, a bearing plate adapted to be fitted over the protruding end portion of the bolt shaft for bearing against a rock surface of the hanging wall; and fastening means for pulling the bearing plate taut against the rock surface of the hanging wall.

In an embodiment of the invention, the side wall comprises at least one surface irregularity provided on an external surface thereof to improve traction between the side wall and resin grout operatively positioned in the hole.

The at least one surface irregularity may be of unitary construction and integrally formed with the side wall such as, for example, an elongate groove formed in and extending helically around the side wall as its extends along the length of the side wall. The surface irregularity may alternatively be formed by swaging or twisting of the side wall.

Alternatively or additionally, the at least one surface irregularity may be shaped by protuberance forming means applied onto a smooth external surface of the side wall. The protuberance forming means may be a separate elongate strip of plate metal helically applied onto the external surface. Alternatively, the protuberance forming means comprises a plurality of knobs applied onto the external surface in an equidistantly spaced apart arrangement.

It will be appreciated that the side wall typically comprises metal tubing.

The bolt shaft may further comprise a proximal end and a distal end, the proximal end defining a chamfered edge terminating in a pointed tip for piercing a resin grout pack operatively located in the hole in the hanging wall.

The distal end may also comprise connection means operable to be connected to coupling means of a substantially hollow bolt shaft extension piece so as to operatively connect a proximal end of the extension piece to the distal end of the bolt shaft thereby to extend the length of the bolt shaft.

The rock anchoring system further includes fastening means in the form of a tautening member operable to, in use, matingly engage and be friction fitted to either a footwall facing end of the extension piece or to the connection means.

The tautening member may comprise a cap screw having a threaded male portion for screwing into a complementary threaded female portion of either a footwall facing end of the extension piece or into to the connection means. Alternatively, the tautening member comprises a nut having a threaded female portion for screwing into a complementary threaded male portion of either a footwall facing end of the extension piece or into the connection means.

The fastening means may further comprise a torque indicating member which visually disintegrates when a suitable amount of torque is applied to the bolt shaft as a result of fastening of the fastening means against the bearing plate. In such a case, the torque indicating member is typically in the form of a washer, which, in use, is slipped over the threaded male portion of the cap screw before being pressed between a footwall facing surface of the bearing plate and a head portion of the cap screw.

Alternatively, the torque indicating member is in the form of a shearing pin, located within the bolt shaft or bolt shaft extension piece, which breaks when a suitable amount of torque is applied to the bolt shaft or bolt shaft extension piece as a result of fastening of the fastening means against the bearing plate.

Moreover, the invention provides for the bolt shaft and bolt shaft extension piece to have end caps for closing off entry to the hollow internal chamber.

The invention also extends to a method of transferring load from the unstable exterior of a hanging wall in an underground environment to the confined, and more stable, interior of the rock mass surrounding the hanging wall comprising:

- locating a resin grout containing pack in an elongate hole drilled in the hanging wall;
- utilizing a rotatable apparatus to position a substantially hollow bolt shaft of a rock anchoring system as described herein, which bolt shaft comprises a pointed end, in the hole;
- forcing the pointed end to puncture the resin grout containing pack;
- rotating the bolt shaft to mix the resin grout until it sets between an interior wall of the drilled hole and surface irregularities formed on the exterior surface of the bolt shaft;
- connecting to the bolt shaft, a substantially hollow bolt shaft extension piece;
- positioning a bearing plate over the extension piece; and
- fastening a fastening means comprising a torque indicating member to the extension piece and against the bearing plate, the torque indicating member being configured to either visually disintegrate or break when a suitable amount of torque is applied to the bolt shaft as a result of fastening of the fastening means.

BRIEF DESCRIPTION OF THE DRAWINGS

Embodiments of the invention are now described, by way of example, with reference to the accompanying non-limiting diagrammatic drawings. In the drawings.

DETAILED DESCRIPTION OF THE DRAWINGS

This description is presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how at least some of the several forms of the invention may be embodied in practice.

Figure 1:
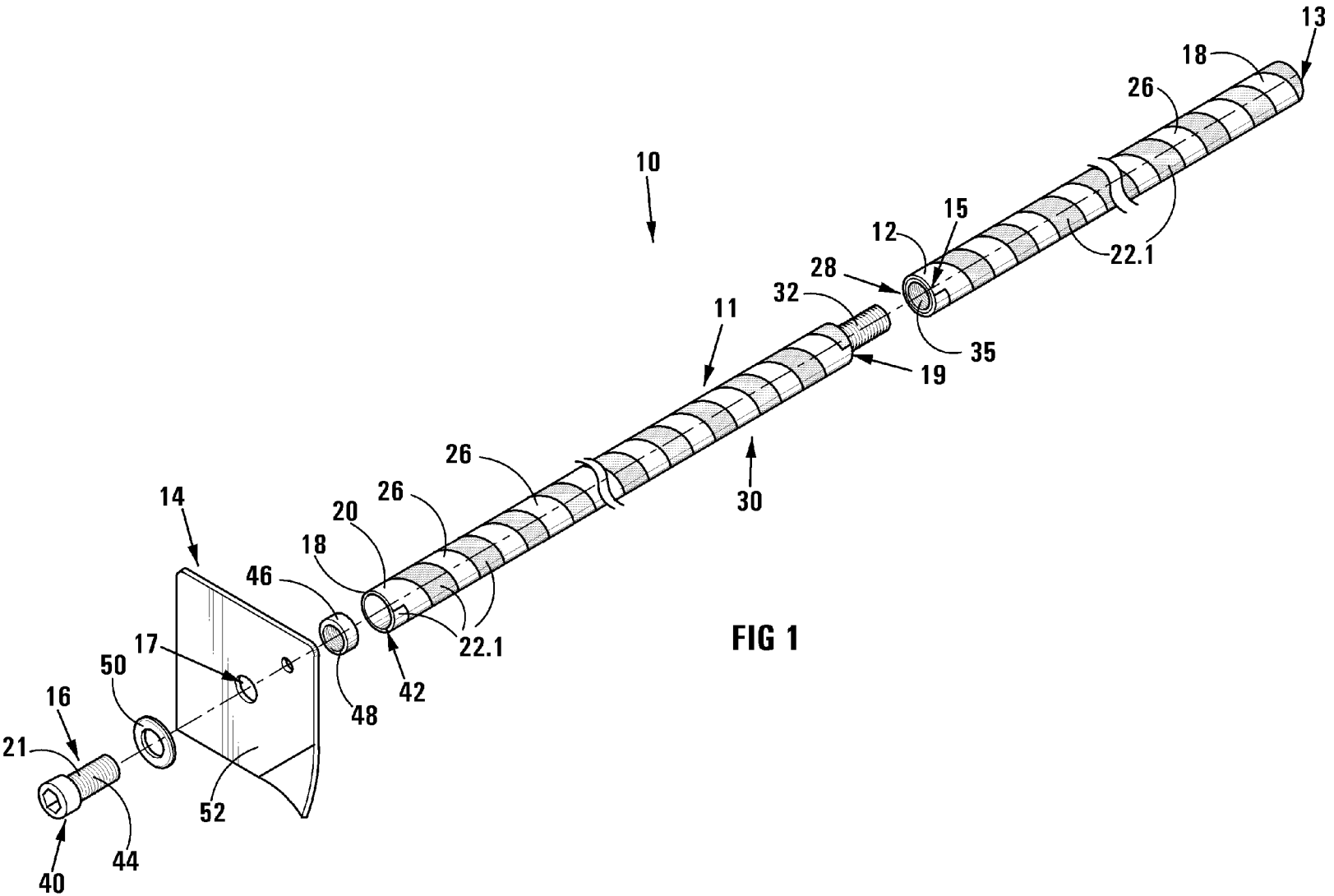
FIG. 1 shows a three-dimensional exploded view of an underground rock anchoring system in accordance with one embodiment of the present invention.
Figure 2:
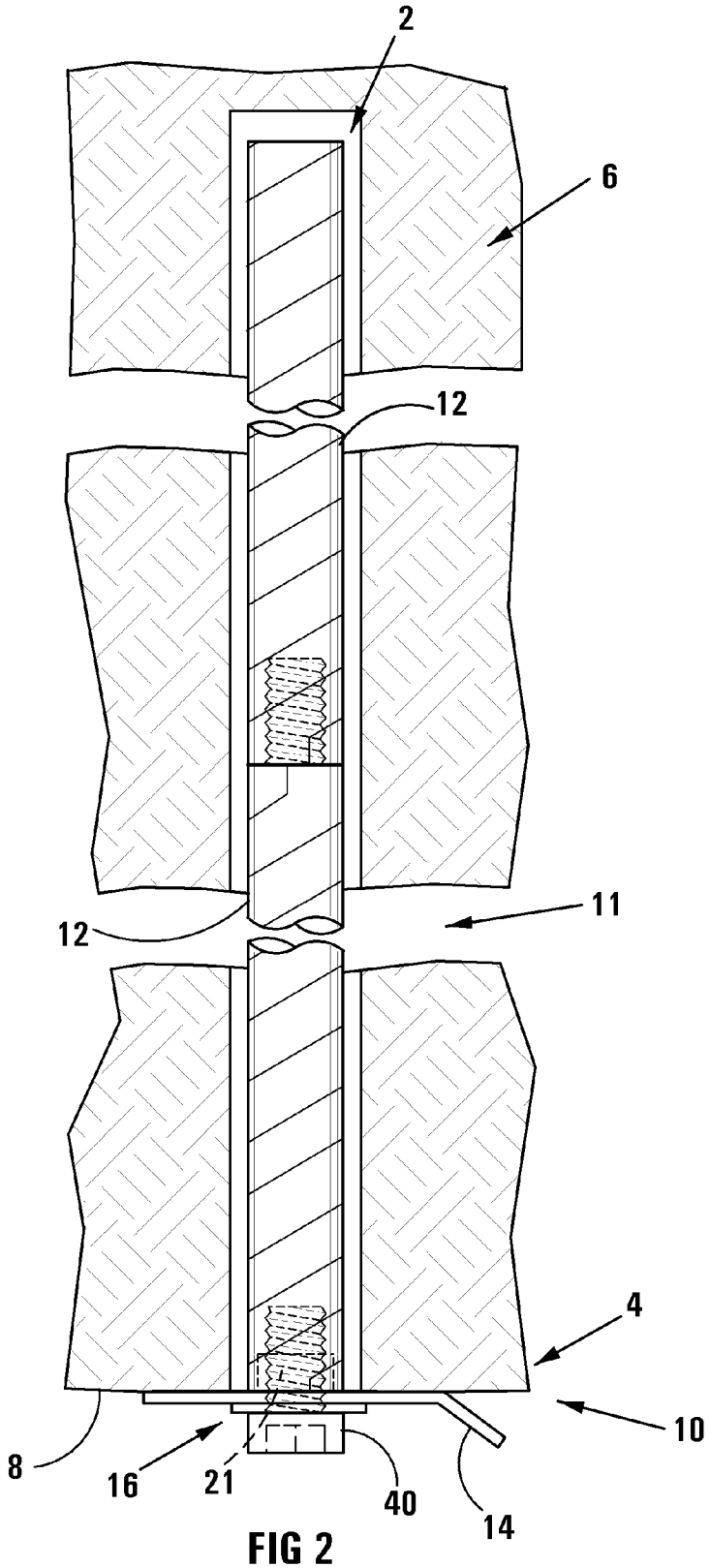
FIG. 2 shows a sectional side view of a rock bolt of the system of FIG. 1 set in a drilled hole in a hanging wall.

Referring to FIGS. 1 and 2, reference numeral 10 generally indicates a rock anchoring system in accordance with the present invention. Rock anchoring system 10 includes a rock bolt 11 being a long anchor bolt which is used for stabilizing rock excavations in an underground environment such as, for example, a mining environment.

Referring to FIG. 2, rock bolt 11 is positionable in an elongate rectilinear drilled hole 2 provided in a hanging wall 4 of a rock excavation. After suitable positioning of rock bolt 11, an epoxy resin grout (not shown) is utilised to assist in setting rock bolt 11 in hole 2. Thus, rock bolt 11 and, consequently, rock anchoring system 10 are secured in a location proximate the confined, and much stronger, interior 6 of the rock mass surrounding an outer rock surface 8 of the hanging wall 4.

As depicted in FIG. 1, rock anchoring system 10 consists of an elongate bolt shaft 12 which is substantially hollow and operatively locatable in hole 2. System 10 also includes a substantially planar bearing plate 14 having a square outline and being adapted to be fitted over bolt shaft 12 by passing bolt shaft 12 through aperture 17. In use, the bearing plate 14 bears against the outer rock surface 8 as shown in FIG. 2. System 10 further includes fastening means 16 for pulling the bearing plate 14 taut against the rock surface 8 of the hanging wall 4.

As shown, bolt shaft 12 is typically, but not necessarily in tubular form, of any suitable length, and preferably manufactured from a metal such as mild steel or from a metal alloy. A side wall 18 of bolt shaft 12 has an external diameter of about 32 mm and defines an external surface 20 which is provided with a surface irregularity 22.1. The surface irregularity 22.1 is specifically provided to improve traction between the shaft's side wall 18 and the resin grout in hole 2.

FIG. 1 shows surface irregularity 22.1 in the form of a separate elongate strip of plate metal, flexible enough to allow same to be helically applied or wound onto the external surface 20 of wall 18. Areas of external surface 20, referred to as troughs 26, remain visible as the strip of plate metal 22.1 is wound and secured lengthwise around shaft 12. On the other hand, areas where the strip of plate metal 22.1 is wound around the wall 18 so as to cover parts of the external surface 20 can be seen as ridges compared to the troughs 26. As such, the strip of plate metal 22.1 functions as a protuberance forming means or ridge forming means when it is applied onto external surface 20. It is envisaged that the strip of plate metal 22.1 may be welded or friction welded onto side wall 18.

Although not shown in the drawings, it will be appreciated that any number of surface irregularities may be provided on external surface 20. It will further be appreciated that in another embodiment of the invention the surface irregularity, or irregularities, may be integrally formed with the side wall 18. For example, it is envisaged that a surface irregularity may be formed by means of a longitudinally extending helical groove provided by, for example, swaging or twisting of the shaft's side wall 18 so as to define ridges interspaced between grooved areas. Typically, a number of grooves will be provided for the side wall, all equidistantly spaced apart along the length of the shaft.

Figure 3:
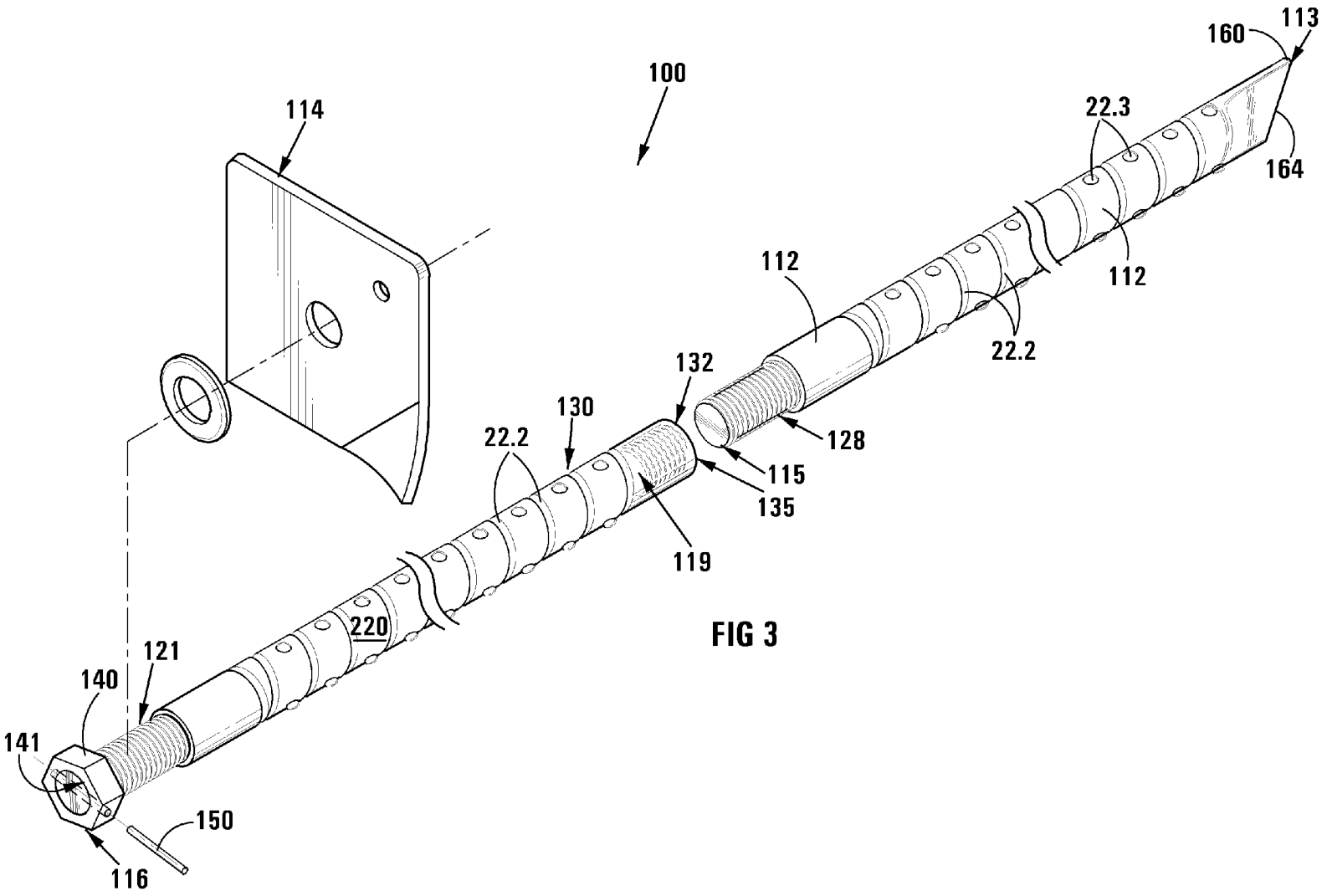
FIG. 3 shows a three-dimensional exploded view of an underground rock anchoring system in accordance with a further embodiment of the present invention.
Figure 4:
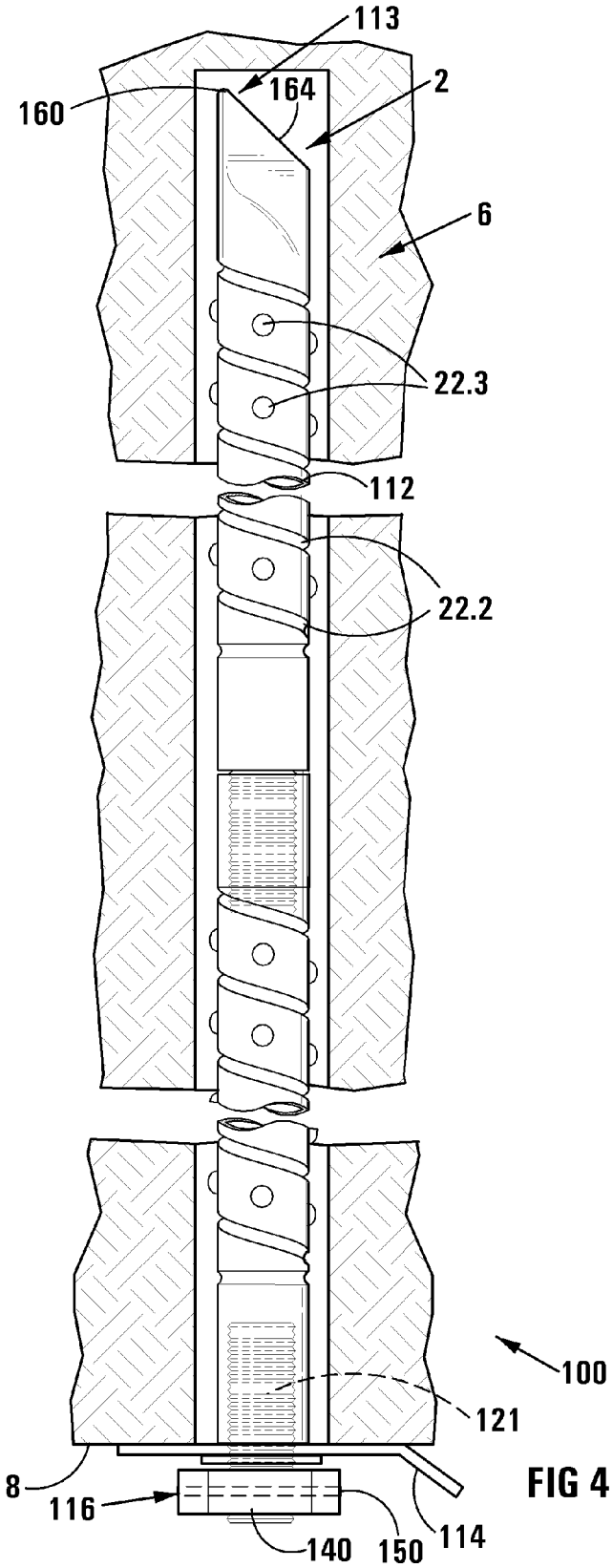
FIG. 4 shows a sectional side view of a rock bolt of the system of FIG. 3 set in a drilled hole in a hanging wall.

Referring to FIGS. 3 and 4, which depict a rock anchoring system 100 in accordance with a further embodiment of the present invention, surface irregularities 22.2 in the form of etched channels are provided on the external surface 220. Not only is the external surface 220 provided with etched channels 22.2, but also with protuberance forming means or surface irregularities in the form of a plurality of equidistantly spaced apart knobs or nipples 22.3, which are typically welded onto the surface 220. These surface irregularities 22.1, 22.2 and 22.3 have proven to bring about a more secure hold of the bolt shaft 12, 112 in the hole 2.

As shown in FIGS. 1 and 2 and in FIGS. 3 and 4 respectively, each bolt shaft 12, 112 has a proximal end 13, 113 and a distal end 15,115.

In FIGS. 3 and 4, the proximal end 113 is shown to include a pointed tip 160 for piercing a resin grout pack 162 operatively located in the hole 2 in the hanging wall. The tip 160 forms a terminating point of a tapered or chamfered edge 164.

Further, as shown in FIGS. 1 and 2 and in FIGS. 3 and 4 respectively, the distal end 15, 115 of each bolt shaft 12, 112 includes connection means 28, 128 operable to be connected to coupling means 32,132 of a substantially hollow bolt shaft extension piece 30, 130. As shown, the coupling means 32,132 is located at a proximal end 19, 119 of the extension piece 30,130. The coupling means 32,132 is in the form of respective screw threaded male and female member adapted to matingly screw into the connection means 28,128 in the form of respective screw threaded complementary shaped male and female portions so as to operatively connect the proximal end 19, 119 of the extension piece 30,130 to the distal end 15, 115 of the bolt shaft 12, 112 thereby to extend the effective length of the bolt shaft 12,112.

It is also envisaged that in other embodiments of the invention, such as where the drilled hole length is less than 1 m the bolt shaft 12,112 without the extension piece 30,130 may be used in system 10, 100. In most other cases the drilled hole length would determine whether one or more extensions 30,130 are required to be coupled to bolt shaft 12, 112 and fitted to the hole 2. The bolt shaft 12,112 and extensions 30, 130 are usually of similar length, but their lengths may differ. It is envisaged that bolt shaft 12,112 and extension 30, 130 length may range between about 0.4 m to about 1.8 m. The connectability of bolt shaft 12, 112 to one or more extensions 30,130 is particularly useful in circumstances where the hanging wall 8 is spaced relatively close to a footwall, such as, for example 1.5 m apart and where relatively deep holes 2 are drilled into the interior 6 of the hanging wall. In such circumstances, ubiquitous rock bolts cannot be used as they only permit limited manoeuvrability.

Further, FIGS. 1 and 3 respectively display fastening means 16,116 having a tautening member 40,140 operable to, in use, matingly engage and be friction fitted to a footwall facing end 21, 121 of the extension piece 30,130.

In the embodiment shown in FIG. 1, the tautening member 40 is a cap screw having a threaded male portion 44 for screwing into a complementary threaded portion 48 of a female member 46, which female member is internally secured and located in the hollow internal chamber 35 defined by the side wall 18 proximate the footwall facing end 21.

In the embodiment shown in FIG. 3, the tautening member 140 is a nut having a threaded female portion 141 for screwing into a complementary threaded male portion or stud of a footwall facing end 121 of the extension piece 130. On the other hand, if the drilled hole length dictates that no extension piece 130 is required, the tautening member 140 is used to directly matingly engage and be friction fitted to the connection means 128.

The fastening means 16,116 further includes a torque indicating member 50, 150.

In FIG. 1, the torque indicating member 50 is in the form of a washer which visually disintegrates when a suitable amount of torque is applied to the bolt shaft 12 as a result of fastening of the fastening means 16 against the bearing plate 14. In use, washer 50 is slipped over the threaded male portion 44 before being pressed between a footwall facing surface 52 of the bearing plate 14 and a head portion of the cap screw 40.

In FIG. 3, the torque indicating member 150 is in the form of a shearing pin, located at least partially within the bolt shaft extension piece 130 or within the bolt shaft 112 if no extension piece 130 is required (not shown). The shearing pin 150 also extends transversely through the nut 140. The shearing pin 150 is specifically selected based on its ultimate strength features, i.e. based on the maximum stress that it can withstand before it breaks. Thus, when a suitable amount of torque is applied to the bolt shaft 112 as a result of fastening of the fastening means 116 against the bearing plate 114, breaking of the pin 150 indicates that the anchoring system 100 is properly secured to the interior 6 of the rock mass surrounding an outer rock surface 8 of the hanging wall 4. Thus, in use, the threaded male portion or stud of the footwall facing end 121 is partially screwed into the hollow internal chamber 135 of extension piece 130, which piece 130 has an internal screw threaded portion (not shown), near the footwall facing end 121, of shorter length than the screw thread provided on the stud. It will be appreciated that as a result of rotation of the nut 140, with the shearing pin 150 connecting the nut 140 to the stud, the stud is rotated into the hollow internal chamber 135 of extension piece 130 until the end of the internal screw threaded portion of extension piece 130 is reached when the pin 150 breaks and the stud secures the washer against the bearing plate 114 and locks itself in that position.

End caps (not shown), configured to close off opposing ends of the elongate bolt shaft 12,112 may also be provided to ensure that no undesired material enters the hollow internal chamber 35, 135 of bolt shaft 12, 112 or extension piece 30, 130.

Figure 5:
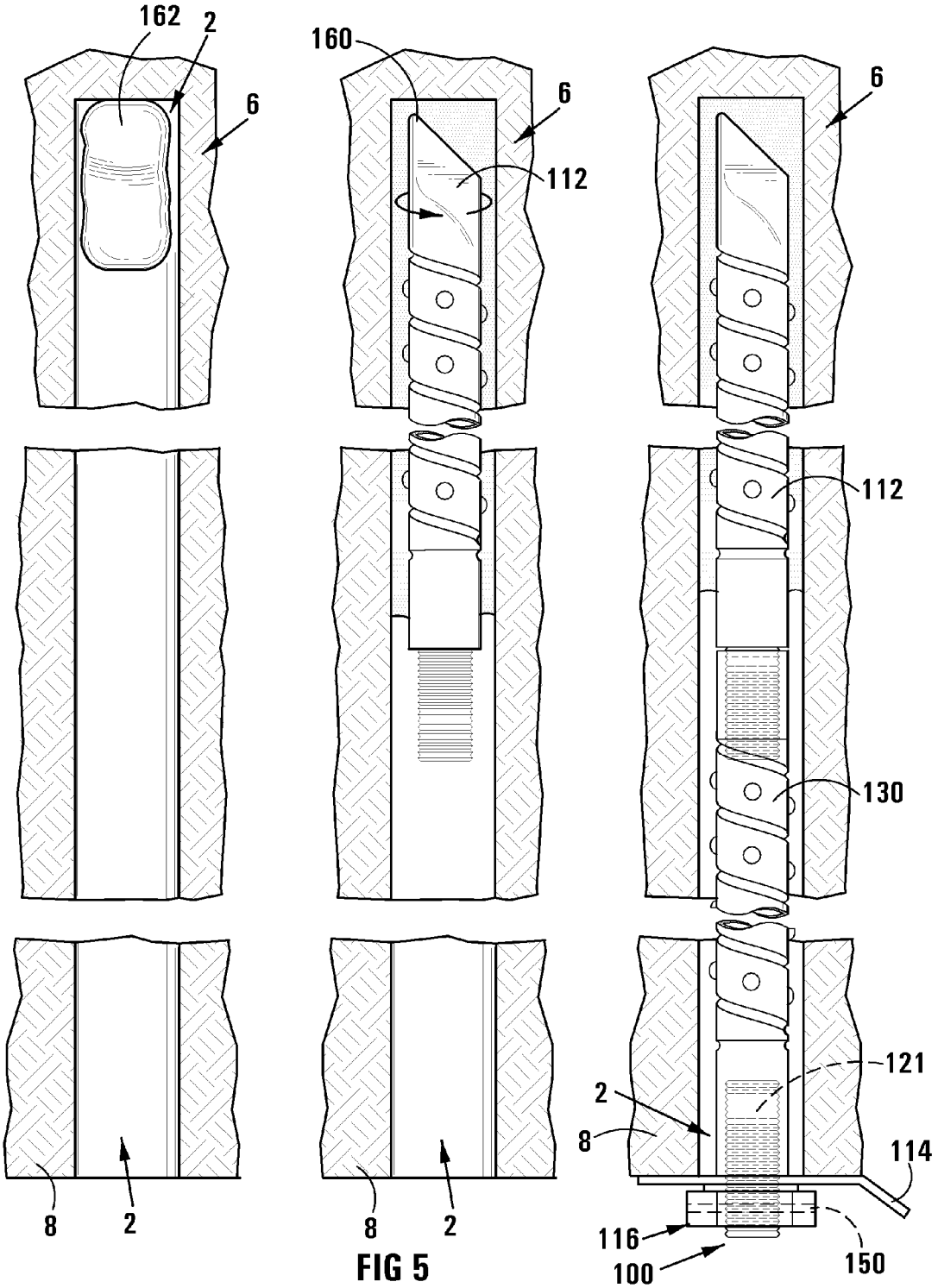
FIG. 5 shows a sectional side view illustrating a rock anchoring method in accordance with a further embodiment of the present invention.

As shown in FIG. 5 of the drawings, the invention also extends to a method 200 of transferring load from the unstable exterior of a hanging wall 4 in an underground environment to the confined, and more stable, interior 6 of the rock mass surrounding the hanging wall 4.

The method 200 includes locating a resin grout containing pack 162 in an elongate hole 2 drilled in the hanging wall 4. Thereafter, a drilling machine (not shown) is utilized to position a substantially hollow bolt shaft 112, of a rock anchoring system 100 as described herein, which bolt shaft comprises a pointed end 160, in the hole 2. The next step includes forcing the pointed end 160 to puncture the resin grout containing pack 162. This is followed by rotation of the bolt shaft 112, typically by means of a drilling machine, to mix the resin grout freed from the pack 162 until it sets between an interior wall of the drilled hole and surface irregularities 22.2 and 22.3 formed on the exterior surface of the bolt shaft 112. Further, a substantially hollow bolt shaft extension piece 130 is connected to the bolt shaft before a bearing plate 114 is positioned over the extension piece 130. Finally, the method 200 includes fastening a fastening means 116 comprising a torque indicating member 150 to the extension piece 130 and against the bearing plate 114, the torque indicating member 150 being configured to break when a suitable amount of torque is applied to the bolt shaft 112 as a result of fastening of the fastening means 116.

The applicant believes that method 200 or use of underground rock anchoring system 10, 100 instead of conventional systems which are not substantially hollow will reduce the concentration of ammonia gas present in levels and stopes, which gas results from excessive use of epoxy resin grout in the drilled holes 2. The method 200, which combines resin grout pack positioning, puncturing and setting of the resin grout with installation of the rock anchoring system 10, 100, also allows workmen and the like to operate at a faster rate as known hereto before when rock anchoring is required in an underground environment.

The applicant also believes that the invention provides a simple, manoeuvrable underground rock anchoring system with improved traction capabilities.

The invention claimed is:

1. An underground rock anchoring system comprising:

a rectilinear blind bore formed within a hanging wall formation;

a resin grout pack disposed internally within said blind bore formed within said hanging wall formation;

a rock bolt comprising a bolt shaft disposed within said rectilinear blind bore formed within said hanging wall formation such that a distal end portion of said bolt shaft protrudes outwardly from said blind bore, said bolt shaft comprising a hollow cylinder defining a hollow tubular portion extending along the length of said bolt shaft;

said bolt shaft comprising multiple sections connected together by an externally threaded male member integrally formed upon a first end of a first one of said multiple sections of said bolt shaft and an internally threaded female member integrally formed upon a first end of a second one of said multiple sections of said bolt shaft which is adapted to be threadedly connected to said first one of said multiple sections of said bolt shaft such that said bolt shaft comprises said multiple sections connected together in order to provide said bolt shaft with a longitudinal extent which is sufficient enough to engage said resin grout pack disposed internally within said blind bore;

a bearing plate adapted to be fitted over said protruding end portion of said bolt shaft for bearing against a rock surface portion of said hanging wall formation; and fastening means for moving said bearing plate taut against said rock surface portion of said hanging wall formation;

said bolt shaft comprising a proximal end disposed within said blind bore wherein said proximal end of said bolt shaft has a chamfered edge terminating in a pointed tip for piercing said resin grout pack disposed within said blind bore of said hanging wall formation such that when said bolt shaft is sufficiently disposed within said blind bore, said pointed tip of said proximal end of said bolt shaft will pierce said resin grout pack so as to permit said resin grout to be displaced around said proximal end of said bolt shaft disposed within said blind bore and downwardly between annular portions defined between substantially the entire length of said bolt shaft, comprising said multiple sections connected together, and interior wall portions defining said blind bore within said hanging wall formation so as to thereby fixedly secure said bolt shaft within said blind bore when said resin solidifies as a result of rotation of said bolt shaft.

2. The rock anchoring system of claim 1, wherein:

an outer peripheral wall portion of said bolt shaft comprises at least one surface irregularity so as to improve traction between said outer peripheral wall portion of said bolt shaft wall and said resin grout.

3. The rock anchoring system of claim 2, wherein:

said at least one surface irregularity of said outer peripheral surface portion of said bolt shaft is of unitary construction and integrally formed with said outer peripheral wall portion of said bolt shaft.

4. The rock anchoring system of claim 2, wherein:

said at least one surface irregularity of said outer peripheral wall portion of said bolt shaft comprises a plurality of protuberances formed upon said outer peripheral wall portion of said bolt shaft.

5. The rock anchoring system of claim 4, wherein:

said plurality of protuberances formed upon said outer peripheral wall portion of said bolt shaft comprises a separate elongate strip of plate metal helically applied onto said outer peripheral wall portion of said bolt shaft.

6. The rock anchoring system of claim 4, wherein:

said plurality of protuberances formed upon said outer peripheral wall portion of said bolt shaft comprises a plurality of knobs applied onto said outer peripheral wall portion of said bolt shaft in an equidistantly spaced apart arrangement.

7. The rock anchoring system of claim 1, wherein:

said fastening means comprises a tautening member operable to, in use, matingly engage and be friction fitted to either a footwall facing end of an extension piece of said bolt shaft.

8. The rock anchoring system of claim 7, wherein:

said tautening member comprises a cap screw having a threaded male portion for threadedly engaging a complementary threaded female portion of either a footwall facing end of said extension piece of said bolt shaft.

9. The rock anchoring system of claim 7, wherein:

said tautening member comprises a nut having a threaded female portion for threadedly engaging a complementary threaded male portion of either a footwall facing end of said extension piece of said bolt shaft.

10. The rock anchoring system of claim 7, wherein:

said bolt shaft and said bolt shaft extension piece have end caps for closing off entry to said hollow tubular portion of said bolt shaft.

11. The rock anchoring system of claim 7, wherein the fastening means comprises a torque indicating member which visually disintegrates when a suitable amount of torque is applied to the bolt shaft as a result of fastening of the fastening means against the bearing plate.

12. The rock anchoring system of claim 11, wherein:

said torque indicating member is in the form of a washer, which, in use, is slipped over the threaded male portion of the cap screw before being pressed between a footwall facing surface of the bearing plate and a head portion of the cap screw.

13. The rock anchoring system of claim 11, wherein:

said torque indicating member is in the form of a shearing pin which breaks when a suitable amount of torque is applied to said bolt shaft as a result of fastening said fastening means against said bearing plate.

14. A method of transferring load from the unstable exterior of a hanging wall formation in an underground environment to the confined, and more stable, interior of the rock mass surrounding the hanging wall formation, comprising the steps of:

forming a rectilinear bore within the hanging wall formation;

inserting a resin grout pack internally within said blind bore formed within said hanging wall formation;

providing an underground rock anchoring system comprising a rock bolt comprising a bolt shaft disposed within said rectilinear blind bore formed within said hanging wall formation such that a distal end portion of said bolt shaft protrudes outwardly from said blind bore, said bolt shaft comprising a hollow cylinder defining a hollow tubular portion extending along the length of said bolt shaft, said bolt shaft comprising multiple sections connected together by an externally threaded male member integrally formed upon a first end of a first one of said multiple sections of said bolt shaft and an internally threaded female member integrally formed upon a first end of a second one of said multiple sections of said bolt shaft which is adapted to be threadedly connected to said first one of said multiple sections of said bolt shaft such that said bolt shaft comprises said multiple sections connected together in order to provide said bolt shaft with a longitudinal extent which is sufficient enough to engage said resin grout pack disposed internally within said blind bore; a bearing plate adapted to be fitted over said protruding end portion of said bolt shaft for bearing against a rock surface portion of said hanging wall formation; and fastening means for moving said bearing plate taut against said rock surface portion of said hanging wall formation; said bolt shaft comprising a proximal end disposed within said blind bore wherein said proximal end of said bolt shaft has a chamfered edge terminating in a pointed tip for piercing said resin grout pack disposed within said blind bore of said hanging wall formation such that when said bolt shaft is sufficiently disposed within said blind bore, said pointed tip of said proximal end of said bolt shaft will pierce said resin grout pack so as to permit said resin grout to be displaced around said proximal end of said bolt shaft disposed within said blind bore and downwardly between annular portions defined between substantially the entire length of said bolt shaft, comprising said multiple sections connected together, and interior wall portions defining said blind bore within said hanging wall formation so as to thereby fixedly secure said bolt shaft within said blind bore when said resin solidifies as a result of rotation of said bolt shaft;

utilizing a rotatable apparatus to position said substantially hollow tubular bolt shaft which comprises said pointed tip, in said blilnd bore;

forcing said pointed tip to puncture said resin grout pack;

rotating said bolt shaft so as to mix the resin grout until said resin grout sets between interior wall portions of said blilnd bore and surface irregularities formed upon exterior surface portions of said bolt shaft;

positioning a bearing plate over said protruding end portion of said bolt shaft; and fastening a fastening means comprising a torque indicating member to said protrudilnq end portion of said bolt shaft and against said bearing plate, said torque indicating member being configured to either visually disintegrate or break when a suitable amount of torque is applied to said bolt shaft as a result of fastening said fastening means.

* * * * *